US006163332A

United States Patent [19]

Klees

[11] Patent Number: 6,163,332

[45] Date of Patent: Dec. 19, 2000

[54] PRINTER AND METHOD OF FORMING MULTIPLE IMAGE PIXEL SIZES ON PHOTOSENSITIVE MEDIA

[75] Inventor: Kevin J. Klees, Rochester, N.Y.

[73] Assignee: Eastman Kodak Company, Rochester, N.Y.

[21] Appl. No.: 08/940,065

[22] Filed: Sep. 29, 1997

[51] Int. Cl.[7] ..... B41J 2/47; B41J 2/45; B41J 15/14; B41J 27/00

[52] U.S. Cl. ..... 347/240; 347/238; 347/243

[58] Field of Search ..... 347/240, 242, 347/238, 243, 241; 358/298

[56] References Cited

U.S. PATENT DOCUMENTS

| | | | |
|---|---|---|---|
| 4,314,261 | 2/1982 | Martinage | 358/298 |
| 4,474,422 | 10/1984 | Kitamura | 359/204 |
| 4,837,589 | 6/1989 | Dodge | 347/242 |
| 4,841,316 | 6/1989 | Pavone et al. | 396/548 |
| 5,119,113 | 6/1992 | Prakash et al. | 347/241 |
| 5,311,255 | 5/1994 | Josephson | 399/6 |
| 5,321,426 | 6/1994 | Baek et al. | 347/240 |
| 5,434,600 | 7/1995 | Schoon | 347/243 |
| 5,745,152 | 4/1998 | Vincent et al. | 347/238 |

FOREIGN PATENT DOCUMENTS

| | | |
|---|---|---|
| 0 529 561 A2 | 8/1992 | European Pat. Off. . |
| 97/21151 | 6/1997 | WIPO . |

*Primary Examiner*—Thinh Nguyen

*Attorney, Agent, or Firm*—Walter S. Stevens

[57] ABSTRACT

Printer apparatus and method of forming multiple image pixel sizes on photosensitive media. The printer comprises a light source for projecting a light beam onto the photosensitive media to form the image pixel on the photosensitive media. An aperture system is interposed between the light source and the photosensitive media for adjustably sizing the light beam, the aperture system having an adjustable aperture plate for receiving the light beam therethrough. The aperture system is adjustable for variably masking a predetermined portion of the light beam, so that the image pixel obtains a predetermined size as the predetermined portion of the light beam is masked. The aperture system includes a guide member having parallel spaced-apart grooves therein. An aperture plate, which slidably engages the grooves, has a first aperture of a first size and a second aperture of a second size spaced-apart from the first aperture. The aperture plate is slidable in the grooves from a first position thereof for allowing the light beam to be received through the first aperture, so as to expose a first image pixel size on the photosensitive media. The aperture plate is also slidable to a second position thereof for allowing the light beam to be received through the second aperture, so as to expose a second image pixel size on the photosensitive media. A transport mechanism transports the light source and aperture system relative to the photosensitive media. Actuators engage the aperture system due to excess travel of the transport mechanism beyond the side edges of the media. When this occurs, the actuators actuate the aperture system, so that the desired aperture is selected.

20 Claims, 6 Drawing Sheets

PRINTER AND METHOD OF FORMING MULTIPLE IMAGE PIXEL SIZES ON PHOTOSENSITIVE MEDIA

FIELD OF THE INVENTION

This invention generally relates to printer apparatus and methods and more particularly relates to a printer apparatus and method of forming multiple image pixel sizes on photosensitive media.

BACKGROUND OF THE INVENTION

In some prior art printers, image pixels are formed on photosensitive media by means of optical energy (e.g., a light beam). One source of this optical energy may be a LED (Light Emitting Diode) housed in the print head, which may also house a focusing lens for focusing the optical energy onto the phtosensitive media. A carriage carrying the print head translates linearly along one dimension of the photosensitive media as the photosensitive media is held momentarily stationary beneath the print head, whereupon the print head prints one or more lines of image data on the photosensitive media. After one sweep of the carriage, the photosensitive media is advanced a predetermined distance and another sweep is performed to print another line of image data on the photosensitive media. By modulating the image data in synchronization with translation speed of the photosensitive media, a complete raster image is eventually printed or exposed onto the photosensitive media.

A typical non-contact LED (Light Emitting Diode) array image printer is disclosed in U.S. Pat. No. 4,837,589 titled "Non-Contact LED-Array Image Printer" issued Jun. 6, 1989 in the name of Dennis W. Dodge. This patent discloses an LED array mounted on a substrate bearing an interface control circuit which receives video data through a ribbon cable. The LED array is imaged by a lens onto an exposure plane on a platen parallel to the direction of scanning. A photosensitive medium is driven in registration in forward and reverse directions biased against the exposure platen which defines the exposure plane. However, it appears that one limitation of this device is that it produces only one size of pixel. Therefore, in order to produce images of multiple pixel resolutions, it is necessary to write pixels of smaller size multiple times to produce larger pixels. This results in lowered printing speed.

Therefore, there has been a long-felt need to provide an apparatus and method of forming multiple image pixel sizes on photosensitive media, which apparatus and method avoid the need to write smaller pixels multiple times to produce pixels of larger size.

SUMMARY OF THE INVENTION

The present invention resides in a printer for forming multiple image pixel sizes on a photosensitive media, comprising a light source for projecting a light beam onto the photosensitive media to for the multiple image pixel sizes on the photosensitive media; and an aperture system interposed between the light source and the photosensitive media for adjustable sizing the light beam, the aperture system including an adjustable aperture plate for receiving the light beam therethrough, the aperture plate being adjustable for variable masking a predetermined portion of the light beam, so that the multiple image pixel sizes are formed on the photosensitive media as the predetermined portion of the light beam is masked.

In one aspect of the invention, the printer comprises a light source for projecting a light beam onto the photosensitive media to form the image pixel on the photosensitive media. An aperture system is interposed between the light source and the photosensitive media for adjustably sizing the light beam, the aperture system comprising an aperture plate having a plurality of optical apertures for receiving the light beam therethrough. The aperture plate is adjustable for variably masking a predetermined portion of the light beam, so that the image pixel obtains a predetermined size as the predetermined portion of the light beam is masked. More specifically, the aperture system also includes a guide member having parallel oppositely-faced grooves therein. The aperture plate, which slidably engages the grooves, has a first aperture of a first size and a second aperture of a second size spaced-apart from the first aperture. The aperture plate is slidable in the grooves from a first position thereof for allowing the light beam to be received through the first aperture. As the light beam is received through the first aperture, a predetermined first image pixel size is formed on the photosensitive media. The aperture plate is also slidable to a second position thereof for allowing the light beam to be received through the second aperture. As the light beam is received through the second aperture, a predetermined second image pixel size is formed on the photosensitive media. An actuator is engageable with the aperture plate for moving the aperture plate, so that the desired aperture size is selected. Moreover, a carriage interconnecting the light source and the aperture system is also provided for carrying the light source and the aperture system relative to the photosensitive media for forming the image pixels on the photosensitive media. In addition, a controller-motor mechanism is connected to the carriage for controllably translating the carriage, so that the carriage controllably carries the light source and the aperture system relative to the photosensitive media. The light source may be an LED (Light Emitting Diode) with a fiber-optic cable interposed between the LED and the photosensitive media for conducting the light beam from the LED to the photosensitive media with minimal energy loss.

An object of the present invention is to provide an apparatus and method of forming multiple image pixel sizes on photosensitive media in a manner that avoids the need to write smaller pixels multiple times to produce pixels of larger size.

Another object of the present invention is to provide an apparatus and method of automatically changing resolution (i.e., size) of the image pixel.

A feature of the present invention is the provision of an aperture system interposed between the light source and the photosensitive media for adjustably sizing the light beam by masking a predetermined portion of the light beam, so that the light beam forms an image pixel of predetermined size.

An advantage of the present invention is image pixel sizes may be automatically changed without requiring additional motors.

Another advantage of the present invention is that use thereof reduces printing time.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
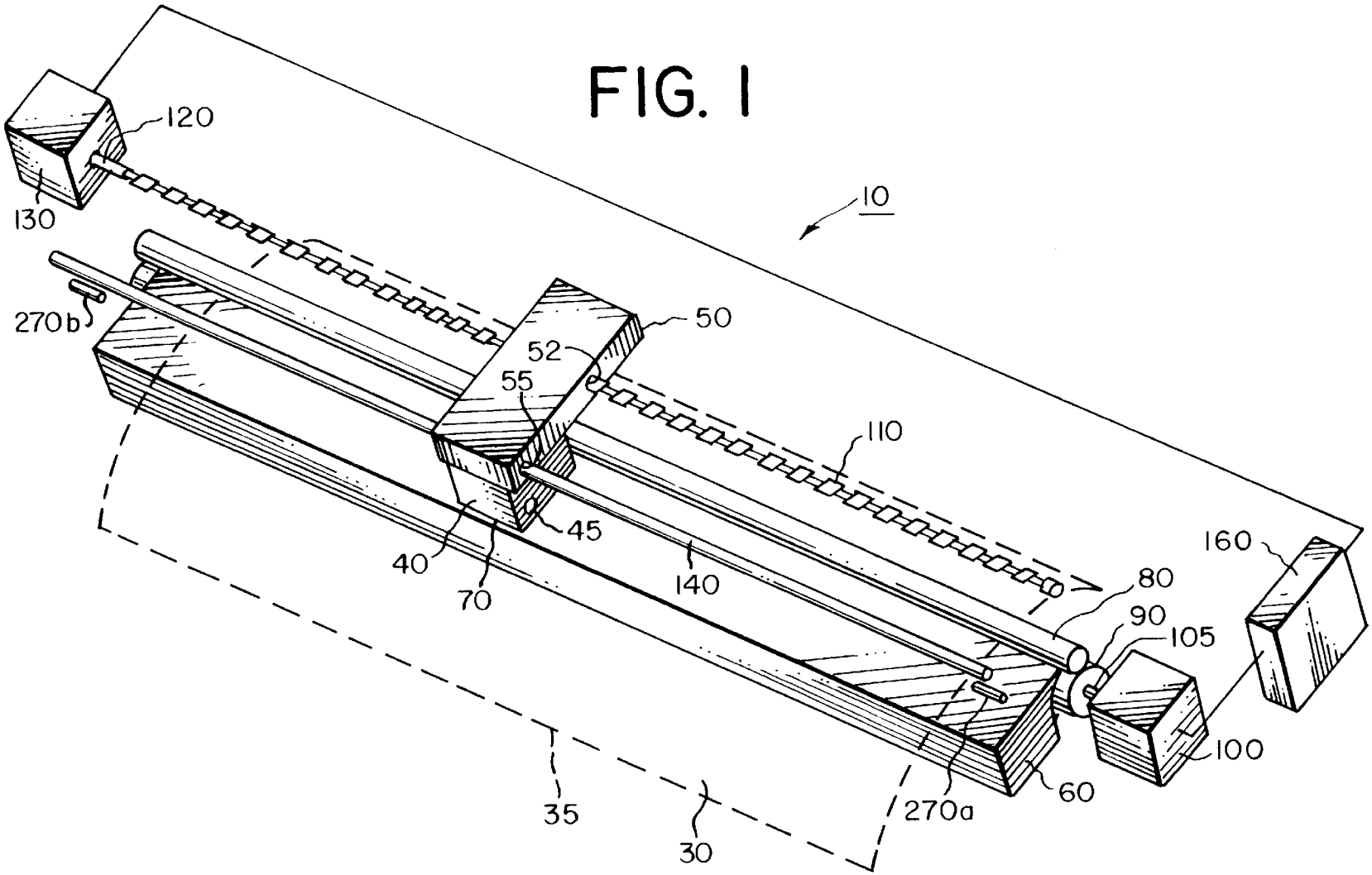
FIG. 1 is a view in perspective of a printer apparatus, with parts removed for clarity.
Figure 2:
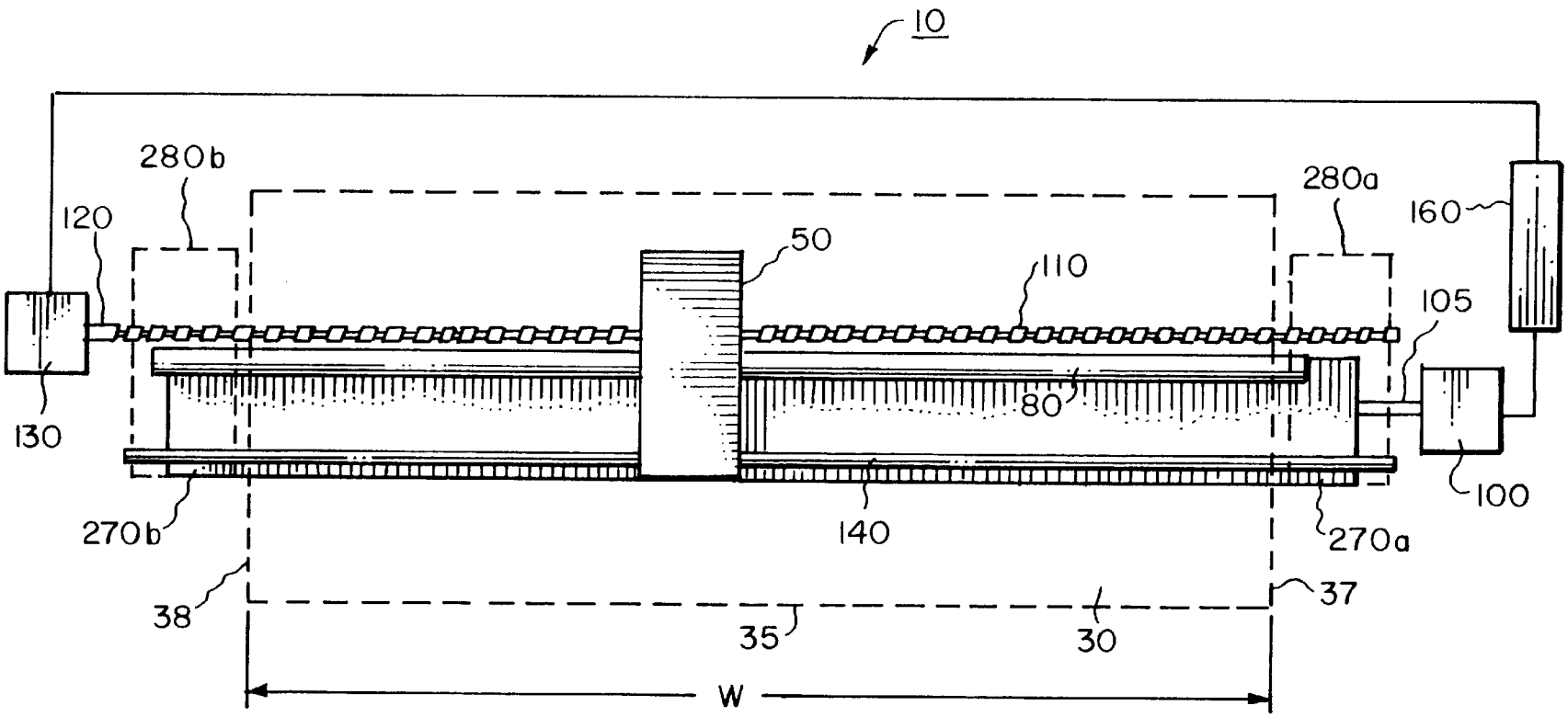
FIG. 2 is a plan view of the printer apparatus.
Figure 3:
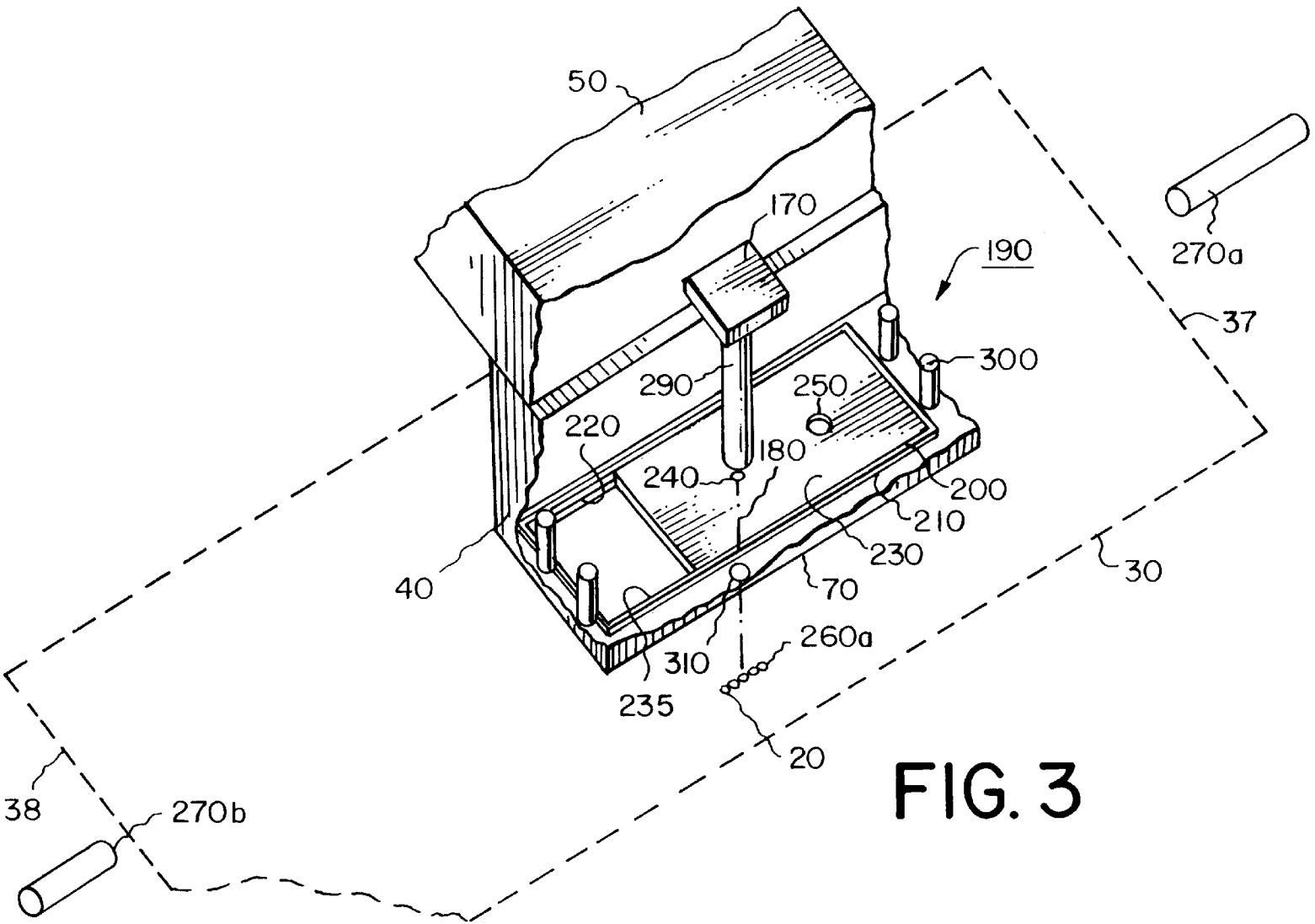
FIG. 3 is a fragmentation view in perspective of a print head belonging to the printer apparatus, the print head shown forming an image pixel of a first predetermined size on a photosensitive media.

Therefore, referring to FIGS. 1, 2 and 3, there is shown a printer apparatus, generally referred to as 10, for forming an image pixel 20 on a photosensitive media 30 in a manner that automatically avoids the need to write smaller pixels multiple times to produce pixels of larger size. In this regard, photosensitive media 30, which has a marginal edge 35, a first side edge 37, a second side edge 38 and also a width "W", may be photosensitive paper or transparency. As described more fully hereinbelow, printer 10 comprises a print head 40, which is capable of being actuated to form image pixels 20 of various predetermined sizes on photosensitive media 30. Print head 40 includes a pair of coaxially aligned holes 45 therethrough (only one of which is shown), for reasons disclosed hereinbelow. In addition, print head 40 is attached to a carriage 50 that carries print head 40 relative to photosensitive media 30. As described more fully hereinbelow, carriage 50 traverses photosensitive media 30 so as to carry print head 40 in a first direction parallel with respect to marginal edge 35. Carriage 50 includes a first bore 52 therethrough lined with internal threads (not shown) and further includes a smooth second bore 55, for reasons disclosed hereinbelow.

Referring again to FIGS. 1, 2 and 3, a support member or platen 60 is disposed near print head 40 for supporting photosensitive media 30 at a location adjacent print head 40. Platen 60 supports print head 40 in a manner such that photosensitive media 30 is interposed between print head 40 and platen 60 and such that photosensitive media 30 drapes platen 60, as shown. In this regard, platen 60 and print head 40 define a gap 70 therebetween of predetermined width for accommodating photosensitive media 30 as photosensitive media 30 traverses through gap 70 in the manner disclosed more fully hereinbelow. In addition, positioned adjacent platen 60 and anteriorly of print head 40 is an elongate photosensitive media nip roller 80. Nip roller 80 is disposed parallel to marginal edge 35. Nip roller 80 engages photosensitive media 30 for biasing photosensitive media 30 against platen 60 as photosensitive media 30 traverses through gap 70. Moreover, also disposed adjacent platen 60 is a photosensitive media translation member, such as a rotatable roller 90. Roller 90 is capable of intimately engaging photosensitive media 30 for translating photosensitive media 30 through gap 70 in a direction perpendicular to the first direction traversed by carriage 50. More specifically, a reversible first motor 100 engages an end portion of roller 90, such as by means of a first axle 105, so that photosensitive media 30 translates through gap 70 as first motor 100 rotates roller 90. First motor 100 is reversible for either advancing or retracting photosensitive media 30 through gap 70. In addition, a rotatable lead screw 110 disposed parallel to marginal edge 35 has exterior threads 140 thereon for threadably engaging the interior threads (not shown) lining first bore 52. A reversible second motor 130 engages an end portion of lead screw 110, such as by means of a second axle 120, so that carriage 50 translates along lead screw 110 as lead screw 110 rotates. Second motor 130 is reversible for reciprocatingly translating carriage 50 along lead screw 110 as lead screw 110 rotates in either a clock-wise or counter clock-wise direction. In this manner, carriage 50 and print head 40 translate parallel to marginal edge 35 of photosensitive media 30. Carriage 50 is itself slidably supported by a smooth elongate support rod 140 disposed parallel to marginal edge 35 and which matingly extends through smooth second bore 55. Thus, carriage 50 slides along support rod 140 and is supported thereby as carriage 50 translates parallel to marginal edge 35. In addition, a controller, which may be a computer 160, is connected to carriage 50 for controlling movement of carriage 50, so that carriage 50 controllably translates print head 40 relative to photosensitive media 30. In this regard, computer 160 is connected to first motor 100 and second motor 120 for controlling operation of first motor 100 and second motor 120, so that print head 40 is controllably carried by carriage 50.

Figure 4:
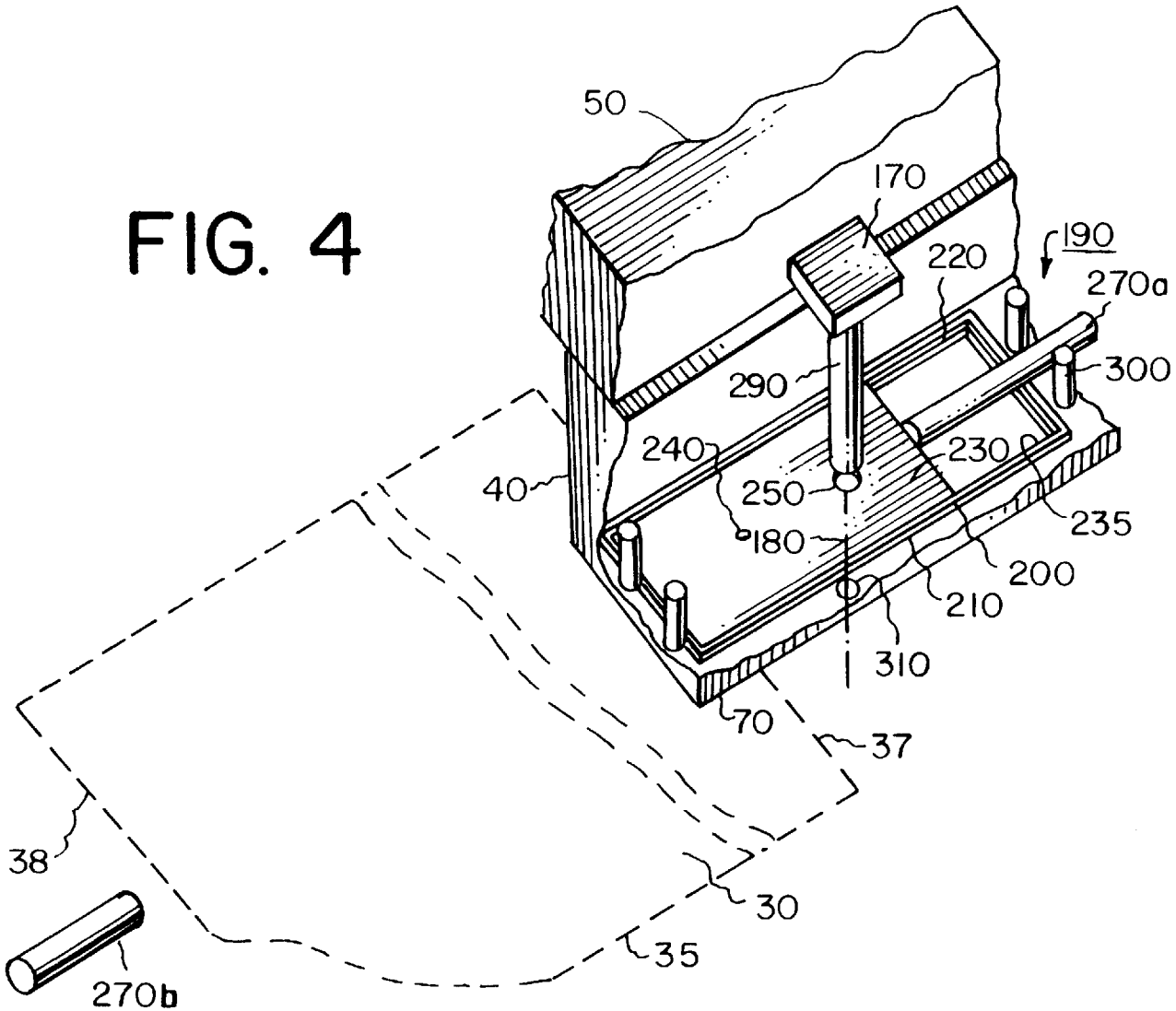
FIG. 4 is a fragmentation view in perspective of the print head disposed in a first resolution changing location beyond a first side edge of the photosensitive media prior to being translated to the photosensitive media in order to form an image pixel of a second predetermined size.
Figure 5:
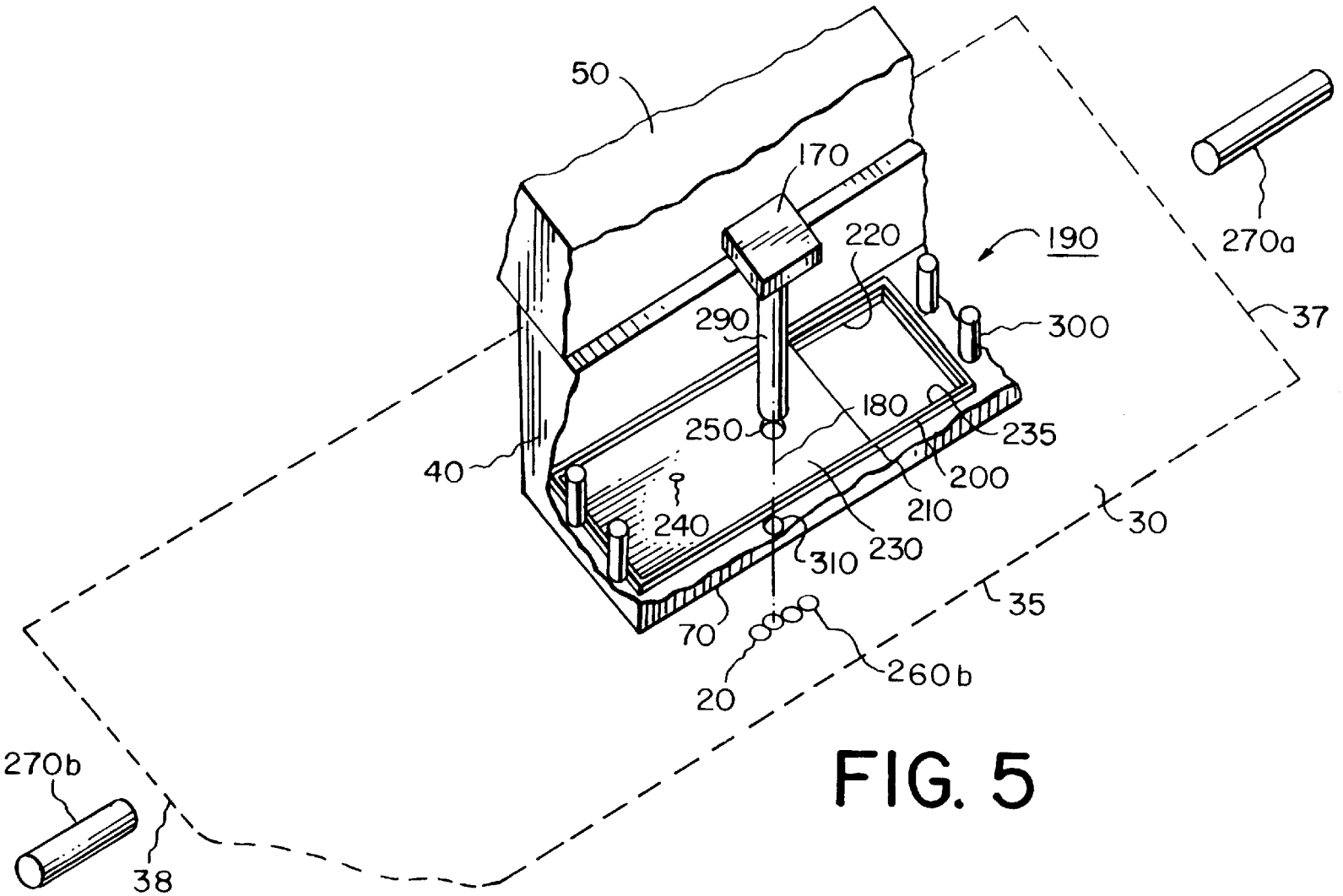
FIG. 5 is fragmentation view in perspective of the print head forming the image pixel of the second predetermined size on the photosensitive media.

Referring now to FIGS. 3, 4 and 5, print head 40 comprises a light source, such as an LED (Light Emitting Diode) 170, for projecting a light beam 180 onto photosensitive media 30 to form image pixel 20 on photosensitive media 30. Although in the preferred embodiment of the present invention, the light source is a LED, any suitable light source may be used, such as a laser. The light source is suitably modulated, by means (not shown) well known in the art, which modulation means synchronizes modulation of the light source to a raster image data source (also not shown). Such modulation results in the desired exposure of the raster image onto photosensitive media 30.

Referring again to FIGS. 3, 4 and 5, an adjustable optical system, generally referred to as 190, is associated with LED 170 for adjustably sizing light beam 180. More specifically, optical system 190 comprises an aperture system 200 disposed in print head 40 and interposed between LED 170 and photosensitive media 30. Aperture system 200 in turn includes a guide member 210 having a pair of parallel oppositely-facing grooves 220 therein for slidably receiving an aperture plate 230. Guide member 210 defines a opening 235 facing photosensitive media 30, for reasons disclosed hereinbelow. Aperture plate 230 has a first aperture 240 of a first size and a second aperture 250 of a second size spaced-apart from first aperture 240, but colinearly-aligned therewith along width "W" of photosensitive media 30. As described more fully hereinbelow, aperture plate 230 is slidable in grooves 220 from a first position thereof (see FIG. 3) for allowing light beam 180 to be received through first aperture 240 to a second position thereof (see FIG. 5) for allowing light beam 180 to be received through second aperture 250. Of course, as light beam 180 passes through either first aperture 240 or second aperture 250, it will also pass through opening 235 to be intercepted by photosensitive media 30. It is appreciated from the description hereinabove that, as light beam 180 is received through first aperture 240 and opening 235, light beam 180 will predetermine a first image pixel size 260*a* (see FIG. 3) and as light beam 180 is received through second aperture 250 and opening 235, light beam 180 will predetermine a second image pixel size 260*b* different than first image pixel size 260*a* (see FIG. 5). Second image pixel size 260*b* is shown of larger size than first image pixel size 260*a* because second aperture 250 is larger than first aperture 240.

Figure 6:
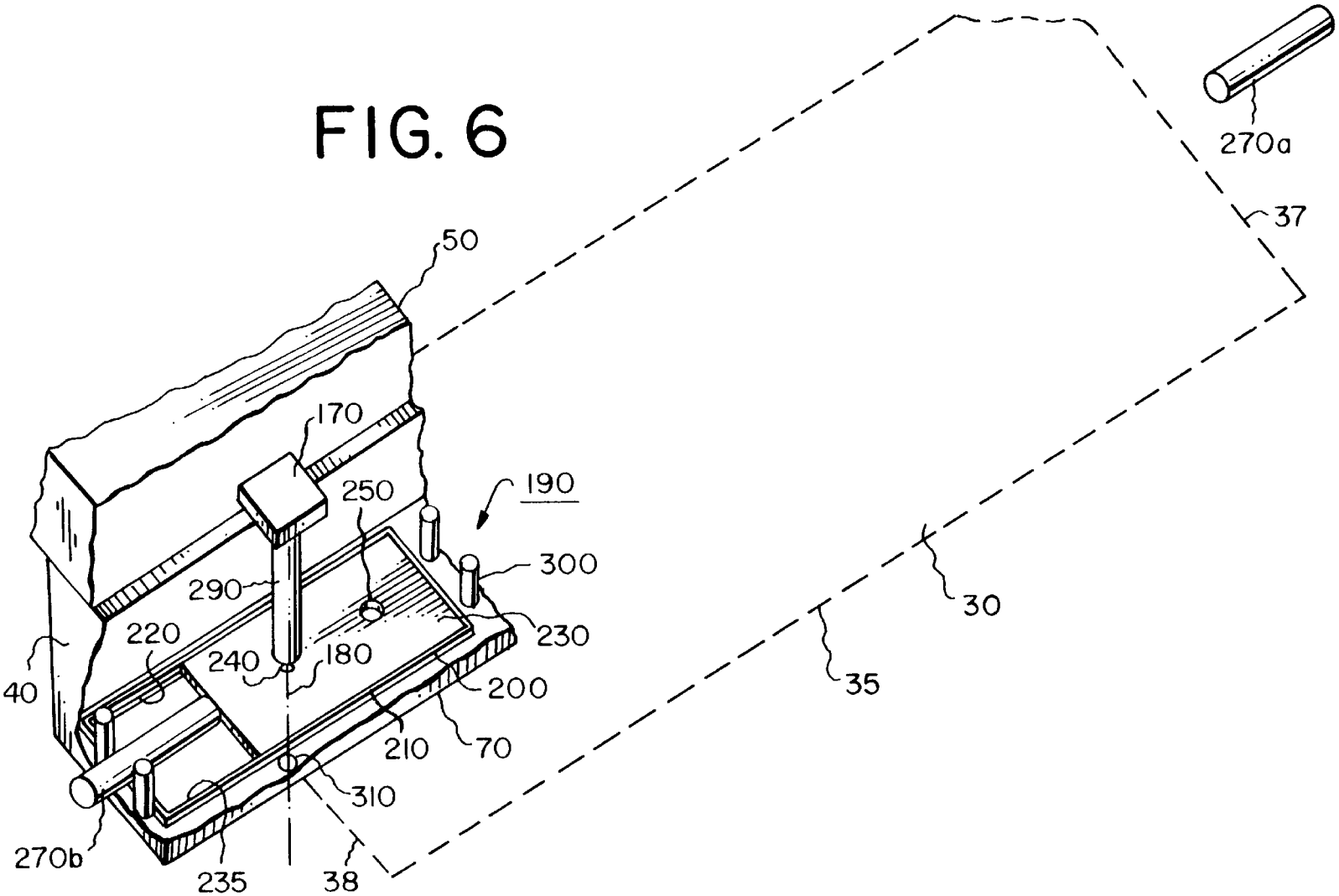
FIG. 6 is a fragmentation view in perspective of the print head disposed in a second resolution changing location beyond a second side edge of the photosensitive media prior to being translated to the photosensitive media in order to form the image pixel of the first predetermined size.

Referring to FIGS. 2, 4 and 6, an actuator assembly, such as an elongate first actuator pin 270*a* and a colinearly aligned elongate second actuator pin 270*b* are provided for sliding aperture plate 230 in grooves 220. For reasons described in more detail presently, first actuator pin 270*a* is disposed a predetermined distance beyond the previously mentioned first side edge 37 of photosensitive media 30 and second actuator pin 270*b* is disposed a predetermined distance beyond the previously mentioned second side edge 38. Both first actuator pin 270*a* and second actuator pin 270*b* are sized to be matingly received through holes 45 in print head 40. Thus, as lead screw 110 translates carriage 50 to a first resolution changing location 280*a* beyond first side edge 37, first actuator pin 270*a* will engage aperture plate 230 to slide aperture plate 230 in grooves 220 to the second position thereof. When the second position of aperture plate 230 is reached, second aperture 250 is aligned with light beam 180 for allowing light beam 180 to be received through second aperture 250. In this manner, the size of the image pixel to be formed on photosensitive media 30 changes to image pixel size 260*b* because light beam 180 now passes through second aperture 250 rather than through first aperture 240. Moreover, as lead screw 110 translates carriage 50 to a second resolution changing location 280*b* beyond second side edge 38, second actuator pin 270*b* will engage aperture plate 230 to slide aperture plate 230 in grooves 220 to the first position thereof. When the first position of aperture plate 230 is reached, first aperture 240 is aligned with light beam 180 for allowing light beam 180 to be received through first aperture 240. In this manner, the size of the image pixel to be formed on photosensitive media 30 changes to image pixel size 260*a* because light beam 180 now passes through first aperture 240 rather than through second aperture 250. It is appreciated that translating carriage 50 to first and second resolution changing locations 280*a*/280*b* beyond first and second side edges 37 and 38, respectively, avoids undesirable exposures on photosensitive media 30 during changing of image pixel resolutions. This is so because light beam 180 is not intercepted by photosensitive media 30 when carriage 50 is disposed in either first resolution changing location 280*a* or second resolution changing location 280*b*. Moreover, it is appreciated that once a resolution (i.e., image pixel size) is selected for imaging on photosensitive media 30, it is not necessary to translate carriage 50 beyond first and second side edges 37/38. That is, carriage 50 is controlled such that an entire raster image comprising a multiplicity of image pixels 20 may be exposed onto photosensitive media 30 at the selected resolution without carriage 50 translating beyond width "W".

Referring to FIGS. 3, 4, 5 and 6, a light transmission conduit, such as a fiber-optic cable 290, may be interposed between LED 170 and aperture plate 230 for conducting and homogenizing light beam 180. Homogenizing light beam 180 tends to "scramble" the spatial intensity pattern of LED 170. Thus, fiber-optic cable 290 provides light beam 180 with an evenly illuminated radiance pattern as light beam 180 exits fiber optic cable 290. This feature of the present invention provides a uniform and well-defined image pixel 20. In addition, aperture system 200 may include a plurality of stops, such as posts 300, disposed adjacent guide member 210 and engageable with aperture plate 230, for terminating translation of aperture plate 230 as aperture plate 230 slides in grooves 220. This feature of the present invention ensures that aperture plate 230 will always remain in grooves 220. Moreover, an optically transparent lens 310 connected to print head 40 and interposed between aperture plate 230 and photosensitive media 30 is provided for focusing light beam 180 onto photosensitive media 30 in order to obtain a sharper and better defined image pixel 20. In addition, lens 310 may be selected to provide a 1:1 magnification ratio or other magnification ratio, as desired.

It is understood from the teachings herein that an advantage of the present invention is image pixel resolutions or sizes may be automatically changed without requiring additional motors. This is so because carriage 50 is merely translated beyond first side edge 37 or second side edge 38 for engaging aperture plate 230 with first and second actuator pins 270*a*/270*b*, when desired. Another advantage of the present invention is that use thereof reduces printing time by avoiding the need to write smaller pixels multiple times to produce pixels of larger size. This so because aperture plate 230 is merely slid from one position thereof to another position thereof to allow light beam 180 to travel through a different size aperture.

The invention has been described in detail with particular reference to certain preferred embodiments thereof, but it will be understood that variations and modifications can be effected within the spirit and scope of the invention. For example, any suitable light source may be used to expose image pixels 20 on photosensitive media 30. As another example, a multiplicity of aperture sizes may be used to obtain a multiplicity of image pixel sizes. As yet another example, alternative means for sliding aperture plate 230 may be used, such as solenoids or motors dedicated to this purpose. However, use of solenoids or motors are not preferred because of increased costs due to purchase and assembly of such additional components.

Therefore, what is provided are an apparatus and method of forming multiple image pixel sizes on photosensitive media, which apparatus and method avoid the need to write smaller pixels multiple times to produce pixels of larger size.

PARTS LIST

10 . . . printer apparatus
20 . . . image pixel
30 . . . photosensitive media
35 . . . marginal edge
37 . . . first side edge
38 . . . second side edge
40 . . . print head
45 . . . hole
50 . . . carriage
52 . . . first bore
55 . . . second bore
60 . . . platen

70 . . . gap
80 . . . photosensitive media nip roller
90 . . . roller
100 . . . first motor
105 . . . first axle
110 . . . lead screw
120 . . . second axle
130 . . . second motor
140 . . . support rod
160 . . . computer
170 . . . LED
180 . . . light beam
190 . . . optical system
200 . . . aperture system
210 . . . guide member
220 . . . grooves
230 . . . aperture plate
235 . . . opening
240 . . . first aperture
250 . . . second aperture
260*a* . . . first image pixel size
260*b* . . . second image pixel size
270*a* . . . first actuator pin
270*b* . . . second actuator pin
280*a* . . . first resolution changing location
280*b* . . . second resolution changing location
290 . . . fiber-optic cable
300 . . . posts
310 . . . lens

What is claimed is:

1. A printer for exposing multiple image pixel sizes on a photosensitive media, comprising:

(a) a light source for generating a light beam to expose a plurality of image pixels on the photosensitive media;

(b) an apertured member associated with said light source, said apertured member laterally shiftable to a first position associated with a first optical aperture thereof of a first size and laterally shiftable to a second position associated with a second optical aperture thereof of a second size, the first optical aperture and the second optical aperture sized to receive the light beam therethrough;

(c) a carriage interconnecting said light source and said apertured member for carrying said light source and said apertured member, said carriage capable of being moved to a first pixel size changing location and to a second pixel size changing location relative to the photosensitive media; and (d) an actuator disposed relative to said carriage and engageable with said apertured member for shifting said apertured member from the first position thereof as said carriage moves to the first pixel size changing location to the second position thereof as said carriage moves to the second pixel size changing location, whereby the light beam is received through the first optical aperture as the apertured member is disposed in the first position, whereby the light beam is received through the second optical aperture as said apertured member shifts to the second position, whereby the image pixel of the first size is exposed on the photosensitive media as the light beam is received through the first aperture, and whereby the image pixel of the second size is exposed on the photosensitive media as the light beam is received through the second aperture.

2. The printer of claim 1, wherein said light source comprises:

(a) a light emitting diode for generating the light beam; and (b) an optical fiber interposed between said light emitting diode and said apertured member for conducting the light beam from the light emitting diode to said apertured member.

3. A printer for forming multiple image pixel sizes on a photosensitive media, comprising:

(a) a light source for projecting a light beam onto the photosensitive media to form the multiple image pixel sizes on the photosensitive media;

(b) an aperture system interposed between said light source and the photosensitive media for adjustably sizing the light beam, said aperture system including a laterally adjustable aperture plate for receiving the light beam therethrough, said aperture plate being adjustable for variably masking a predetermined portion of the light beam, so that the multiple image pixel sizes are formed on the photosensitive media as the predetermined portion of the light beam is masked;

(c) an actuator engageable with said aperture system for actuating said aperture system, so that said aperture plate is adjusted thereby;

(d) a movable carriage interconnecting said light source and said aperture system for carrying said light source and said aperture system relative to the photosensitive media; and (e) a controller connected to said carriage for controlling said carriage, so that said carriage controllably carries said light source and said aperture system relative to the photosensitive media.

4. The printer of claim 3, wherein said light source is a light emitting diode.

5. The printer of claim 3, further comprising a fiber-optic conduit interposed between said light source and the photosensitive media for conducting the light beam from said light source to the photosensitive media.

6. A printer for forming multiple image pixel sizes on a photosensitive photosensitive media, comprising:

(a) a light emitting diode for projecting a light beam onto the photosensitive media to form the multiple image pixel sizes on the photosensitive media; and (b) an aperture system interposed between said light emitting diode and the photosensitive media for adjustably sizing the light beam, said aperture system including:

(i) a guide member having parallel oppositely-facing grooves therein; and (ii) an aperture plate slidable in the grooves, said aperture plate having a first aperture of a first size and a second aperture of a second size spaced-apart from the first aperture, said aperture plate being slidable in the grooves from a first position thereof allowing the light beam to be received through the first aperture for predetermining a first image pixel size to a second position thereof allowing the light beam to be received through the second aperture for predetermining a second image pixel size;

(c) a first elongate actuator pin engageable with said aperture plate for sliding said aperture plate to the first position thereof;

(d) a second elongate actuator pin engageable with said aperture plate for sliding said aperture plate to the second position thereof; and (e) a fiber-optic cable interposed between said light emitting diode and said aperture plate for conducting the light beam and to homogenize the light beam;

(f) a carriage interconnecting said light emitting diode and said aperture system for carrying said light emitting diode and said aperture system in a first direction relative to the photosensitive media; and (g) a computer electrically connected to said carriage for controlling said carriage, so that said carriage controllably carries said light emitting diode and said aperture system.

7. The printer of claim 6, further comprising a carriage translation mechanism connected to said carriage and said computer for controllably translating said carriage in the first direction.

8. The printer of claim 6, further comprising a photosensitive media translation mechanism disposed near said carriage and engageable with the photosensitive media for translating the photosensitive media past said carriage in a second direction perpendicular to the first direction of said carriage.

9. The printer of claim 6, wherein said computer is electrically connected to said photosensitive media translation mechanism for controllably operating said translation mechanism.

10. The printer of claim 6, further comprising a lens interposed between said aperture plate and the photosensitive media for focusing the light beam onto the photosensitive media.

11. A method of exposing multiple image pixel sizes on a photosensitive media, comprising the steps of:

(a) generating a light beam to expose a plurality of image pixels on the photosensitive media;

(b) laterally shifting an apertured member associated with the light source to a first position associated with a first optical aperture thereof of a first size;

(c) laterally shifting the apertured member to a second position associated with a second optical aperture thereof of a second size, the first optical aperture and the second optical aperture capable of receiving the light beam therethrough;

(d) carrying the light source and the apertured member on a carriage;

(e) moving the carriage to a first pixel size changing location and to a second pixel size changing location relative to the photosensitive media; and (f) shifting the apertured member from the first position thereof as the carriage moves to the first pixel size changing location to the second position thereof as the carriage moves to the second pixel size changing location, whereby the light beam is received through the first optical aperture as the apertured member is disposed in the first position thereof, whereby the light beam is received through the second optical aperture as the apertured member shifts to the second position thereof, whereby the image pixel of the first size is exposed on the photosensitive media as the light beam is received through the first aperture, and whereby the image pixel of the second size is exposed on the photosensitive media as the light beam is received through the second aperture.

12. The method of claim 11, wherein the step of generating a light beam comprises the steps of:

(a) generating the light beam using a light emitting diode; and (b) conducting the light beam from the light emitting diode to the apertured member using an optical fiber interposed between the light emitting diode and the apertured member.

13. A method of providing a printer for forming multiple image pixel sizes on a photosensitive media, comprising the steps of:

(a) projecting a light beam onto the photosensitive media to form the multiple image pixel sizes on the photosensitive media by using a light source;

(b) adjustably sizing the light beam by using a laterally aperture system interposed between the light source and the photosensitive media, the aperture system including an adjustable aperture plate for receiving the light beam therethrough, the aperture plate being adjustable for variably masking a predetermined portion of the light beam, so that the multiple image pixel sizes form as the predetermined portion of the light beam is masked;

(c) actuating the aperture system by using an actuator engageable with the aperture system, so that the aperture plate is adjusted thereby;

(d) carrying the light source and the aperture system relative to the photosensitive media by using a movable carriage interconnecting the light source and the aperture system; and (e) controlling the carriage by using a controller connected to the carriage, so that the carriage controllably carries the light source and the aperture system relative to the photosensitive media.

14. The method of claim 13, wherein the step of projecting the light beam comprises the step of using a light emitting diode.

15. The method of claim 13, further comprising the step of conducting the light beam from the light source to photosensitive media by using a fiber-optic conduit interposed between the light source and the photosensitive media.

16. A method of providing a printer for forming multiple image pixel sizes on a photosensitive photosensitive media, comprising the steps of:

(a) providing a light emitting diode for projecting a light beam onto the photosensitive media to form the multiple image pixel sizes on the photosensitive media; and (b) providing an aperture system interposed between the light emitting diode and the photosensitive media for adjustably sizing the light beam, the step of providing an aperture system including the steps of:

(i) providing a guide member having parallel spaced-apart grooves therein; and (ii) providing an aperture plate slidable in the grooves, the aperture plate having a first aperture of a first size and a second aperture of a second size spaced-apart from the first aperture, the aperture plate being slidable in the grooves from a first position thereof allowing the light beam to be received through the first aperture for predetermining a first image pixel size to a second position thereof allowing the light beam to be received through the second aperture for predetermining a second image pixel size;

(c) providing a first elongate actuator pin engageable with the aperture plate for sliding the aperture plate to the first position thereof;

(d) providing a second elongate actuator pin engageable with the aperture plate for sliding the aperture plate to the second position thereof; and (e) providing a fiber-optic cable interposed between the light emitting diode and the aperture plate for conducting the light beam and to homogenize the light beam;

(f) providing a carriage interconnecting the light emitting diode and the aperture system for carrying the light emitting diode and the aperture system in a first direction relative to the photosensitive media; and (g) providing a computer electrically connected to the carriage for controlling the carriage, so that the carriage controllably carries the light emitting diode and the aperture system.

17. The method of claim 16, further comprising the step of providing a carriage translation mechanism connected to the carriage and the computer for controllably translating the carriage in the first direction.

18. The method of claim 16, further comprising the step of providing a photosensitive media translation mechanism disposed near the carriage and engageable with the photosensitive media for translating the photosensitive media past the carriage in a second direction perpendicular to the first direction of the carriage.

19. The method of claim 18, wherein the step of providing a photosensitive media translation mechanism comprises the step of providing a computer electrically connected to the photosensitive media translation mechanism for controllably operating the translation mechanism.

20. The method of claim 16, further comprising the step of providing a lens interposed between the aperture plate and the photosensitive media for focusing the light beam onto the photosensitive media.

* * * * *

UNITED STATES PATENT AND TRADEMARK OFFICE

CERTIFICATE OF CORRECTION

PATENT NO.: 6,163,332
DATED: December 19, 2000
INVENTOR(S): Kevin J. Klees It is certified that an error appears in the above-identified patent and that said Letters Patent is hereby corrected as shown below:

| | |
|---|---|
| Col. 10, Claim 13, Line 7 | delete "laterally" |
| Col., Claim 13, Line 10 | after "an" insert --laterally-- |

Signed and Sealed this

Fifteenth Day of May, 2001

*Attest:*

Nicholas P. Godici

NICHOLAS P. GODICI

*Attesting Officer*

*Acting Director of the United States Patent and Trademark Office*